US006135237A

United States Patent [19]

Allman

[11] Patent Number: 6,135,237

[45] Date of Patent: Oct. 24, 2000

[54] STAMP-FORMED MUFFLER

[75] Inventor: James R. Allman, North Vernon, Ind.

[73] Assignee: Arvin Industries, Inc., Columbus, Ind.

[21] Appl. No.: 09/285,863

[22] Filed: Apr. 2, 1999

Related U.S. Application Data

[60] Provisional application No. 60/080,720, Apr. 3, 1998.

[51] Int. Cl.[7] ..... F01N 7/18

[52] U.S. Cl. ..... 181/282; 181/264; 181/268; 181/227; 181/228

[58] Field of Search ..... 181/282, 264, 181/212, 175, 268, 277, 227, 228, 239, 241; 165/52, 154, 157, 159, 161, 162

[56] References Cited

U.S. PATENT DOCUMENTS

| | | | |
|---|---|---|---|
| 2,066,467 | 1/1937 | Gray . | |
| 2,070,543 | 2/1937 | Cary et al. . | |
| 2,484,826 | 10/1949 | Harley . | |
| 3,638,756 | 2/1972 | Thiele . | |
| 4,079,810 | 3/1978 | Prather et al. . | |
| 4,132,286 | 1/1979 | Hasui et al. . | |
| 4,456,091 | 6/1984 | Blanchot . | |
| 4,635,752 | 1/1987 | Jennings | 181/241 |
| 4,673,058 | 6/1987 | Roberts et al. . | |
| 4,700,806 | 10/1987 | Harwood | 181/282 |
| 4,756,383 | 7/1988 | Sterrett . | |
| 4,860,853 | 8/1989 | Moring, III . | |
| 4,901,815 | 2/1990 | Harwood et al. | 181/282 |
| 4,901,816 | 2/1990 | Garey . | |
| 4,909,348 | 3/1990 | Harwood et al. . | |
| 4,928,372 | 5/1990 | Harwood et al. . | |
| 4,941,545 | 7/1990 | Wilcox et al. . | |
| 4,953,660 | 9/1990 | Jewell, Jr. et al. . | |
| 5,012,891 | 5/1991 | Macaluso | 181/282 |
| 5,147,987 | 9/1992 | Richardson et al. . | |
| 5,198,625 | 3/1993 | Borla . | |
| 5,229,557 | 7/1993 | Allman et al. . | |
| 5,252,788 | 10/1993 | Emrick et al. . | |
| 5,563,385 | 10/1996 | Harwood . | |
| 5,597,986 | 1/1997 | Harwood et al. . | |
| 5,717,173 | 2/1998 | Gerber et al. . | |
| 5,816,361 | 10/1998 | Gerber . | |
| 5,907,904 | 6/1999 | Gerber et al. . | |

FOREIGN PATENT DOCUMENTS

| | | |
|---|---|---|
| 59-41618 | 3/1984 | Japan . |
| 2 120 318 | 11/1983 | United Kingdom . |

*Primary Examiner*—Paul Ip
*Assistant Examiner*—Edgardo San Martin
*Attorney, Agent, or Firm*—Barnes & Thornburg

[57] ABSTRACT

A muffler comprises an outer shell defining a chamber, a baffle positioned in the chamber defined by the outer shell, and an inner plate positioned in the chamber. The inner plate includes a channel and a ridge coupled to the channel. The ridge extends away from the channel. The baffle includes an outer edge positioned adjacent to the outer shell and an inner edge positioned adjacent to the ridge and spaced apart from the channel.

42 Claims, 5 Drawing Sheets

10
12
44
44
42
32
38
34
46
48
244
176
87
244
188
228
254
168
22
256
242
16
238
77
242
220
212
20
83
112
244
278
72
274
278
116
259
76
165
270
79
110
78
184
155
81
270
75
220
178
244
96
74
99
85
242
256
228
98
190
157
120
254
278
242
257
112
276
73
72
256
170
244
95
212
240
167
22
114
118
116
120
110
93
157
242
70
186
254
157
56
94
242
97
18
62
60

14
58
66
64
54
52
68

STAMP-FORMED MUFFLER

CROSS-REFERENCES TO RELATED APPLICATIONS

This application claims priority under U.S.C. § 119 (e) to U.S. Provisional Application No. 60/080,720, filed Apr. 3, 1998, which is expressly incorporated by reference herein.

STATEMENT REGARDING FEDERALLY SPONSORED RESEARCH OR DEVELOPMENT

Not Applicable.

BACKGROUND OF THE INVENTION

1. Field of the Invention

This invention relates to exhaust systems and, in particular, to mufflers for quieting the exhaust noise of a vehicle engine. More particularly, this invention relates to mufflers having stamped outer shells and stamped inner plates.

2. Description of the Related Art Including Information Disclosed Under 37 CFR 1.97 and 1.98.

Stamp-formed mufflers include a plurality of chambers and tubes formed between the stamped outer shells and inner plates. The chambers and tubes direct exhaust gas of the vehicle engine through the muffler in a desired manner to quiet the exhaust noise produced by the vehicle engine effectively.

BRIEF SUMMARY OF THE INVENTION

According to the present invention, a muffler is provided including an outer shell defining a chamber, a baffle positioned in the chamber defined by the outer shell, a first inner plate positioned in the chamber, and a second inner plate positioned in the chamber. The second inner plate includes a channel and a ridge coupled to the channel. The channel and the first inner plate cooperate to define a passage therebetween having an axis. The ridge extends away from the channel and the axis. The baffle includes an outer edge positioned adjacent to the outer shell and an inner edge positioned adjacent to the ridge.

According to a preferred embodiment of the present invention, the channel has an inner surface and an outer surface and the ridge has an inner surface and an outer surface. The outer surface of the channel is spaced apart from the axis by a first distance and the outer surface of the ridge is spaced apart from the axis by a second distance that is greater than the first distance so that the outer surface of the ridge is positioned adjacent to the baffle. The second inner plate further includes a first end, a second end spaced apart from the first end, and a stop contacting the baffle to prevent movement of the baffle toward one of the first and second ends of the second inner plate.

A method of assembling a muffler is also provided. The method includes providing an outer shell defining a chamber, a baffle, a first inner plate, and a second inner plate including a channel and a ridge coupled to the channel. The channels of the second inner plate and the first inner plate cooperate to define a passage therebetween. The baffle is slid relative to the second inner plate into contact with the ridge. Next, the baffle, first inner plate, and second inner plate are positioned in the chamber defined by the outer shell.

Additional features of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
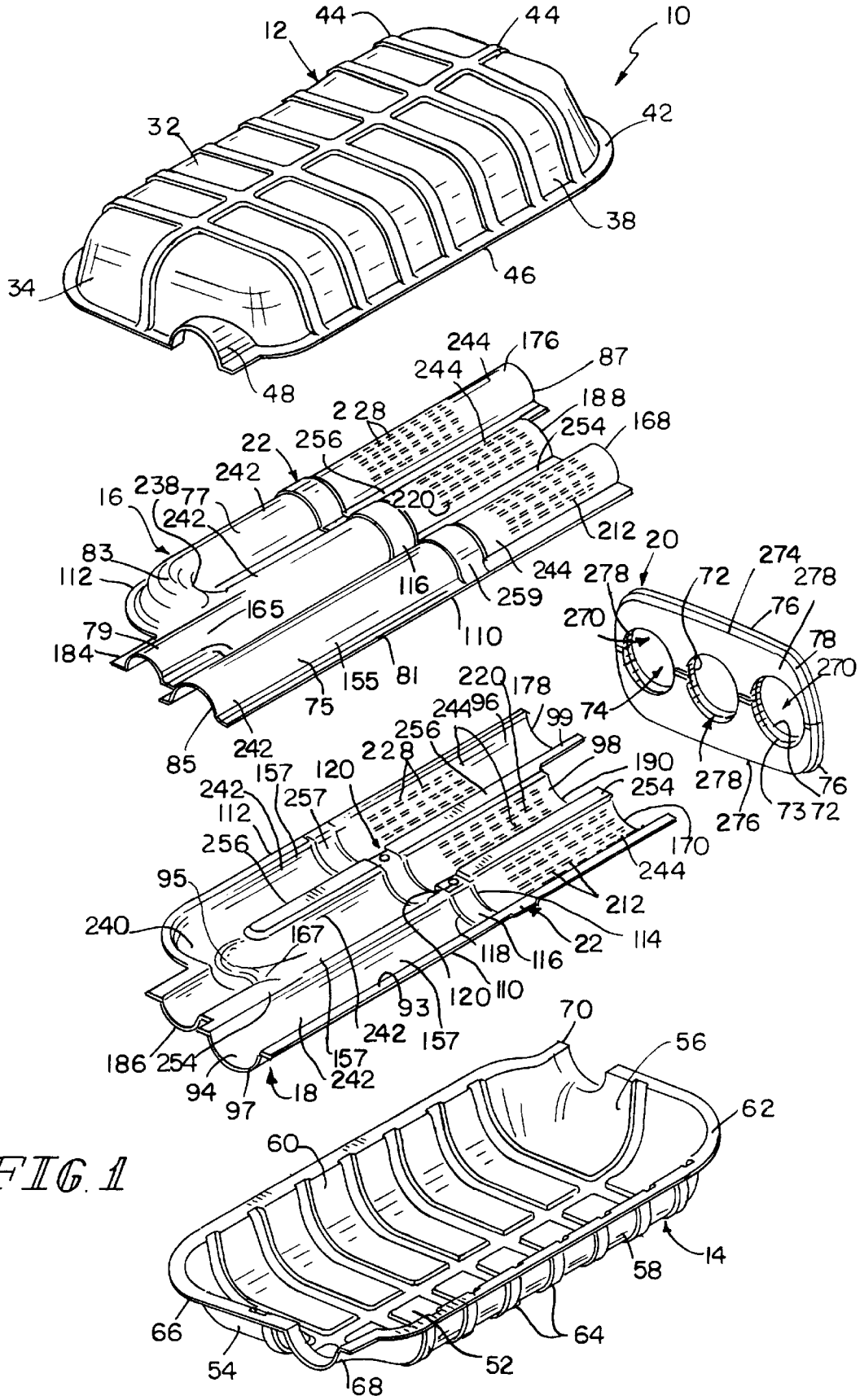
FIG. 1 is an exploded perspective view of a stamp-formed muffler according to the present invention showing the stamp-formed muffler including a top stamped outer shell, a bottom stamped outer shell, a first stamped inner plate, a second stamped inner plate, and a baffle plate, the first and second stamped inner plates being formed to include baffle ridges.

A stamp-formed muffler 10 having a top stamped outer shell 12, a bottom stamped outer shell 14, a first stamped inner plate 16, a second stamped inner plate 18, and a baffle plate 20 is shown in FIG. 1. Stamp-formed muffler 10 is assembled by placing first and second inner plates 16, 18 together, positioning or sliding baffle plate 20 over first and second inner plates 16, 18, and placing or positioning baffle plate 20 and first and second inner plates 16, 18 in first and second outer shells 12, 14. First and second stamped inner plates 16, 18 include a baffle ridge 22 as shown in FIGS. 1–3 and 5–8. Baffle plate 20 contacts baffle ridges 22 after baffle plate 20 is slid onto first and second stamped inner plates 16, 18 as shown, for example, in FIGS. 5 and 8.

Figure 5:
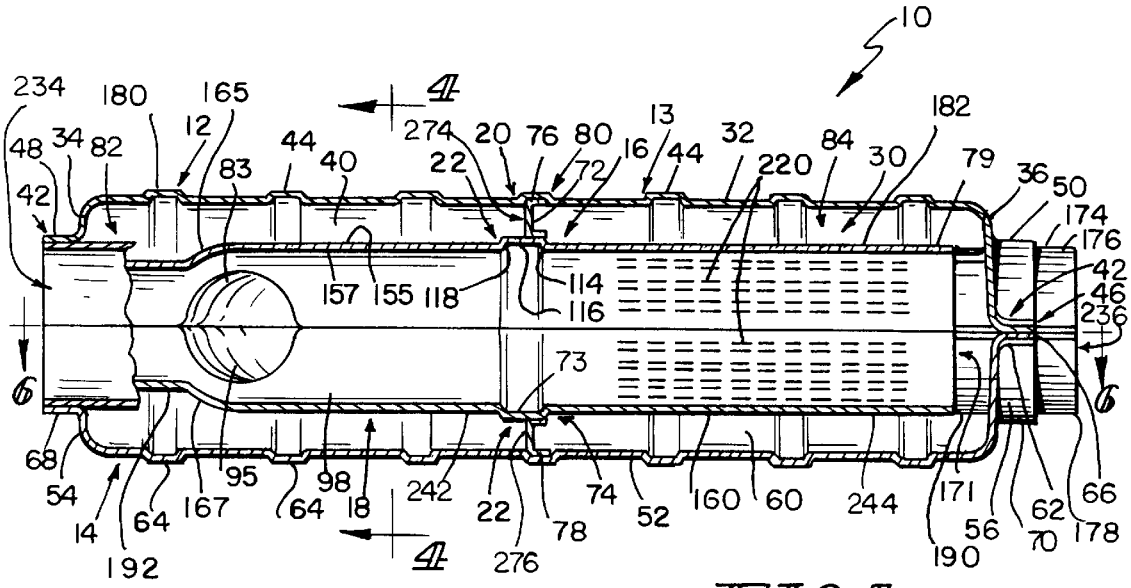
FIG. 5 is a sectional view, taken along line 5—5 of FIG. 4, with portions cut away, showing the baffle plate abutting the baffle ridge formed in the first and second stamped inner plates.
Figure 4:
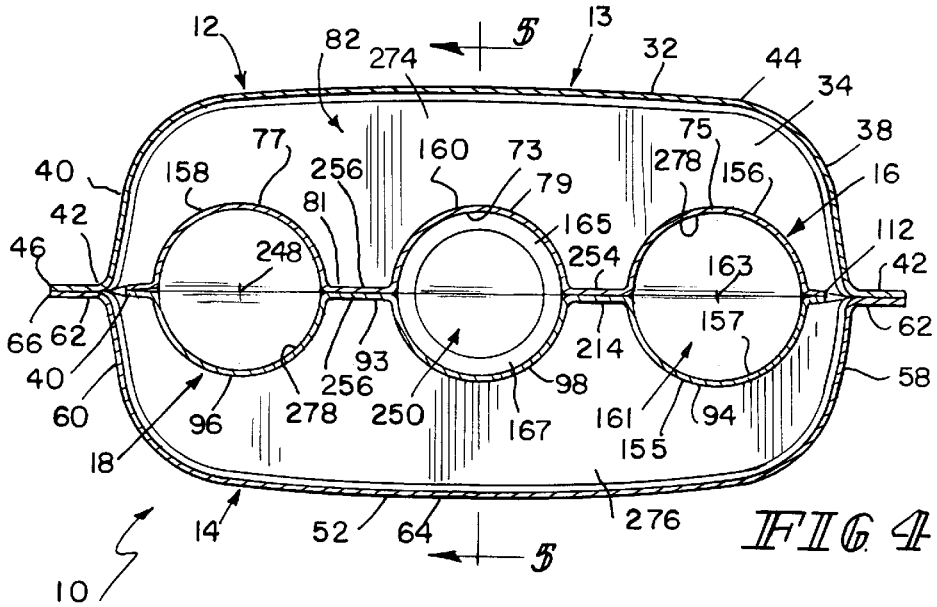
FIG. 4 is a sectional view, taken along line 4—4 of FIG. 5, showing the first and second stamped inner plates and baffle plate positioned to lie between the top and bottom stamped outer shells.

Top stamped outer shell 12 is shaped to include various functional contours and edges as shown, for example, in FIG. 1. Top stamped outer shell 12 includes a top wall 32, first and second end walls 34, 36, first and second side walls 38, 40 extending between first and second end walls 34, 36, and a flange 42 appended to side walls 38, 40 and end walls 34, 36 as shown in FIGS. 1, 4 and 5. First and second end walls 34, 36 and first and second side walls 38, 40 are appended to top wall 32 and extend from top wall 32 to flange 42 at a perimeter edge 46 as shown in FIGS. 1, 4, and 5. Top wall 32, first and second end walls 34, 36, and first and second side walls 38, 40 are formed to include stiffening ribs 44. Stiffening ribs 44 raise the resonant frequency of the top stamped outer shell 12 which reduces the vibration of and noise created by top stamped outer shell 12. First end wall 34 is formed to include an inlet passageway 48 and second end wall 36 is formed to include an outlet passageway 50 as shown in FIGS. 1 and 5.

Similar to top stamped outer shell 12, bottom stamped outer shell is also formed to include various functional contours and edges as shown, for example, in FIG. 1. Bottom stamped outer shell 14 includes a bottom wall 52, first and second end walls 54, 56, first and second side walls 58, 60 extending between first and second end walls 54, 56, and a flange 62 appended to end walls 54, 56 and side walls 58, 60. First and second end walls 54, 56 and first and second side walls 58, 60 are appended to bottom wall 52 and extend from bottom wall 52 to flange 62 at a perimeter edge 66 as shown in FIGS. 1 and 4–6. Bottom wall 52, first and second end walls 54, 56, and first and second side walls 58, 60 are formed to include stiffening ribs 64. Stiffening ribs 64 raise the resonant frequency of the bottom stamped outer shell 14 which reduces the vibration of and noise created by bottom stamped outer shell 14. First end wall 54 is formed to include an inlet passageway 68 and second end wall 56 is formed to include an outlet passageway 70 as shown in FIGS. 1 and 5.

Figure 6:
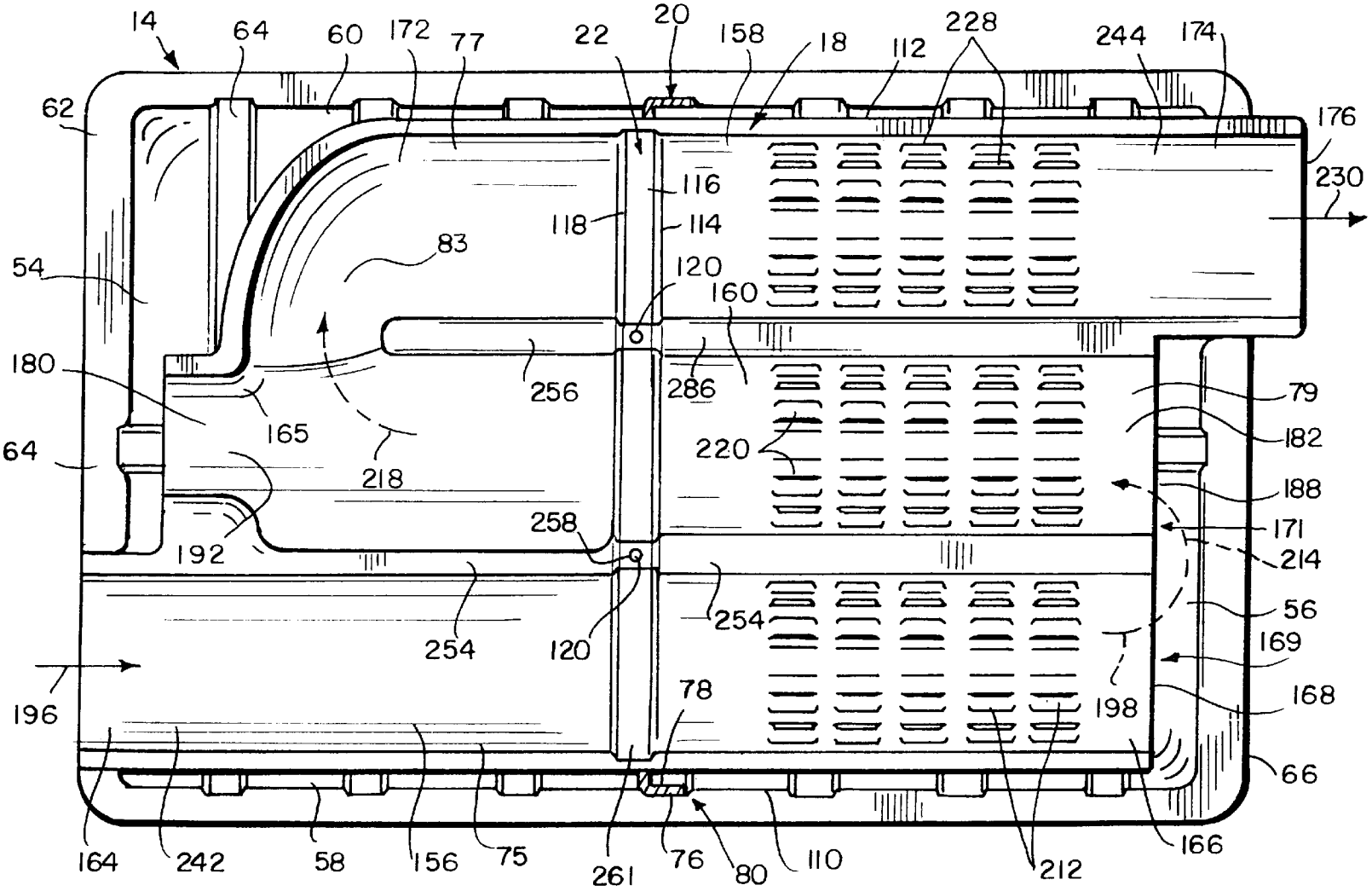
FIG. 6 is a sectional view, taken along line 6—6 of FIG. 5, showing the second stamped inner plate and the baffle plate, in cross section, lying in the bottom stamped outer shell and the flow of exhaust gas (in phantom) between an inlet and outlet of the muffler through the plurality of tubes formed by the first and second stamped inner plates.

Top and bottom outer shells 12, 14 cooperate to define an outer shell 13 defining a plate-receiving chamber 30 therein. Other configurations of outer shells known to those of ordinary skill in the art may also be used with inner plates 16, 18. Top and bottom outer shells 12, 14 accept first and second stamped inner plates 16, 18 and baffle plate 20. Top and bottom stamped outer shells 12, 14 are then welded or otherwise mechanically fastened together along perimeter edges 46, 66 to form stamp-formed muffler 10. Top and bottom stamped outer shells 12, 14 are therefore mated along perimeter edges 46, 66 to define plate-receiving chamber 30 and to secure baffle plate 20 and first and second stamped inner plates 16, 18 between top and bottom stamped outer shells 12, 14 as shown, for example, in FIG. 5. As shown in FIGS. 4 and 6, first and second inner plates 16, 18 are not connected to top and bottom outer shells 12, 14 along bases 81, 93. However, in alternative embodiments, the bases may extend out to the top and bottom outer shells and be welded, crimped or otherwise coupled to the top and bottom outer shells.

Baffle plate 20 interacts with top and bottom stamped outer shells 12, 14 and first and second stamped inner plates 16, 18 to partition chamber 30 into first and second sub-chambers 82, 84 as shown in FIG. 5. Baffle plate 20 is formed to include a continuous inner flange 72 including an inner edge 73 that defines an inner plate-receiving aperture 74 and an outer flange 76 having an outer edge 78 as shown in FIGS. 1, 2, and 5–8. First and second stamped inner plates 16, 18 extend through inner plate-receiving aperture 74 as shown, for example, in FIGS. 2 and 5–8. First and second stamped inner plates 16, 18 are secured to baffle plate 20 by a press-fit between ridges 22 of first and second inner plates 16, 18 and inner flange 72 of baffle plate 20. In alternative embodiments, the baffle plate may be welded or otherwise coupled to the inner plates.

Figure 8:
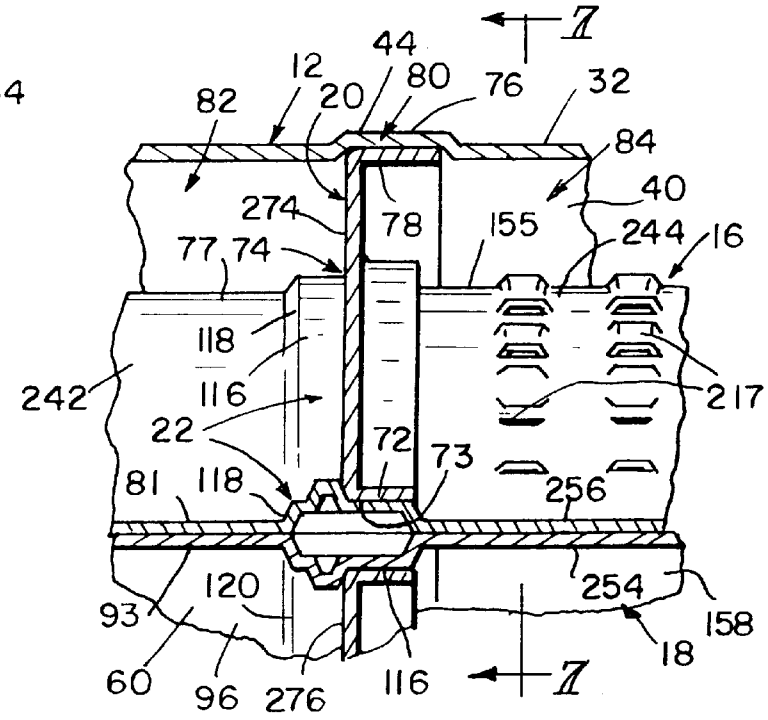
FIG. 8 is a partial sectional view, taken along line 8—8 of FIG. 7, showing the baffle plate abutting the top stamped outer shell and the stops.

Outer flange 76 of baffle plate 20 contacts top and bottom stamped outer shells 12, 14 as shown in FIGS. 5–8. More specifically, outer flange 76 is positioned to lie in a groove 80 formed by stiffening ribs 44, 64 of top and bottom stamped outer shells 12, 14 as shown, for example, in FIGS. 5–8 so that outer edge 78 is adjacent to outer shell 13 as shown in FIG. 8 preventing movement of baffle plate 20 relative to outer shell 13. As shown in FIG. 4, baffle plate 20 includes a first portion 274 extending between first outer shell 12 and first inner plate 16 and a second portion 276 extending between second outer shell 14 and second inner plate 18. Second portion 276 is integral with first portion 274 such that first and second portions 274, 276 are formed from a single unitary sheet of material. In an alternative embodiment, the outer flange of the baffle plate may be welded or otherwise coupled to the top and bottom outer shells. In yet another alternative embodiment, the outer flange of the baffle plate is not nested in grooves but remains adjacent to the top and bottom outer shells and free-floats between the top and bottom outer shells.

Figure 2:
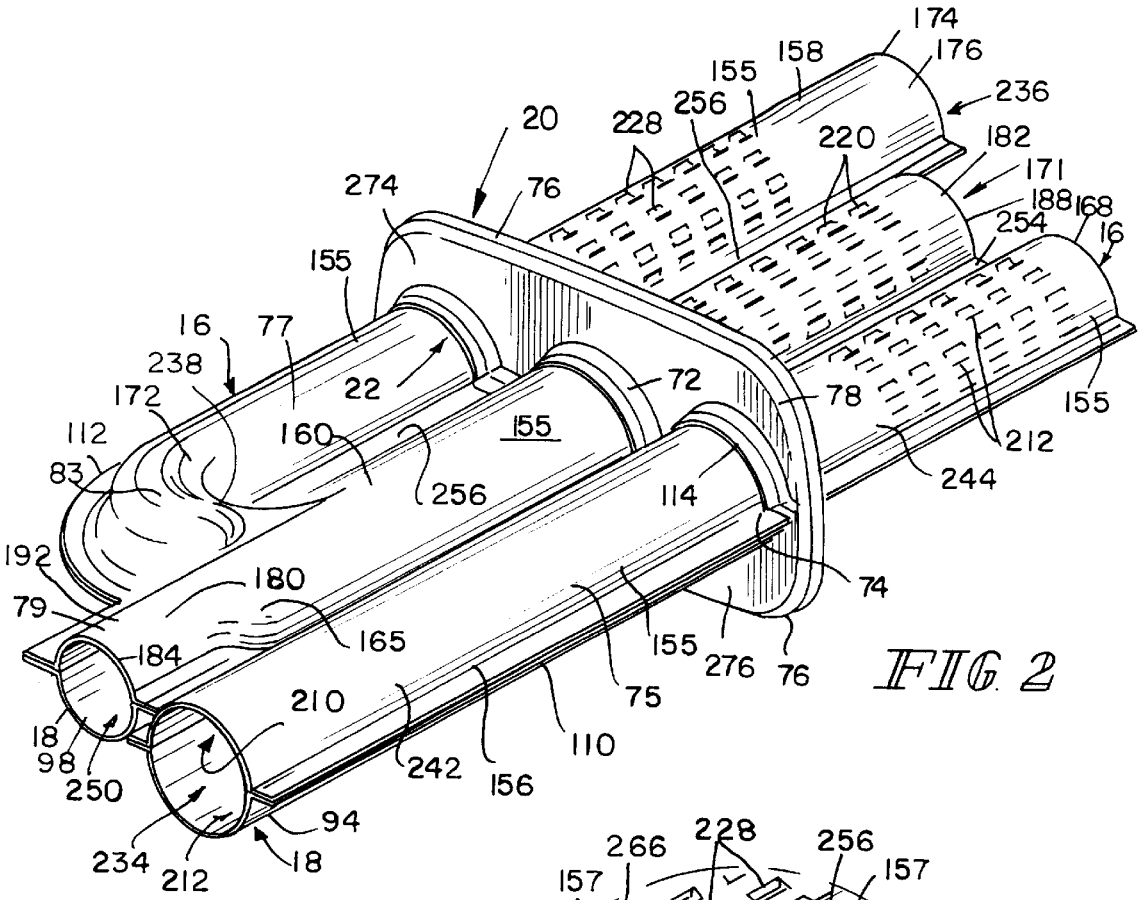
FIG. 2 is a perspective view of the first and second stamped inner plates and the baffle plate showing the inner plates connected to each other to form a plurality of tubes and extending through an inner plate-receiving aperture formed in the baffle plate so that the baffle plate abuts the baffle ridges formed in the first and second stamped inner plates.
Figure 3:
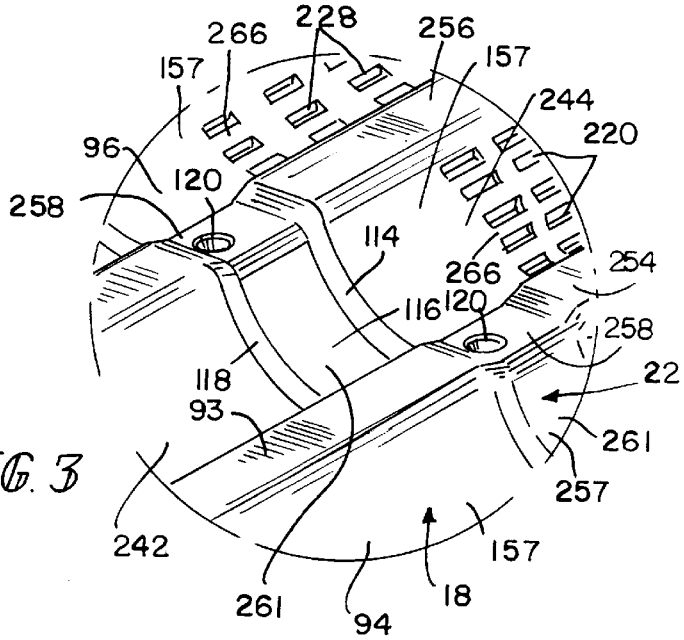
FIG. 3 is a partial perspective view of the baffle ridge formed in the second stamped inner plate showing the second inner plate including a dimple-shaped stop coupled to the ridge.

First and second inner plates 16, 18 are stamped from a sheet of stainless steel in the shape as shown in FIGS. 1 and 2. In alternative embodiments, the components of the muffler may be stamped from sheets of cold-rolled, stainless steel, aluminized stainless steel, and any other appropriate type of material. First inner plate 16 includes a base 81, a first end 85, a second end 87 spaced apart from first end 85, an inlet channel 75 coupled to base 81, an outlet channel 77 coupled to base 81, an intermediate channel 79 coupled to base 81 and positioned to lie between inlet and outlet channels 75, 77, and a duct 83 coupled to base 81, intermediate channel 79, and outlet channel 77 that communicates with and extends between outlet channel 77 and intermediate channel 79 to permit communication therebetween as shown in FIGS. 1 and 2.

Second inner plate 18 is similar to first inner plate 16 and includes a base 93, a first end 97, a second end 99 spaced apart from the first end 97, an inlet channel 94 coupled to base 93, an outlet channel 96 coupled to base 93, an intermediate channel 98 coupled to base 81 and positioned to lie between inlet and outlet channels 94, 96, and a duct 95 coupled to base 93, intermediate channel 98, and outlet channel 96 that extends between outlet channel 96 and intermediate channel 98 to permit communication therebetween as shown in FIGS. 1 and 2. Base 81 of first inner plate 16 and base 93 of second inner plate 18 contact one another, as shown in FIG. 4, and define a plane partitioning outer shell 13 into first and second outer shell portions.

First and second stamped inner plates 16, 18 are stamped to include contours that aid in inserting and positioning first and second stamped inner plates 16, 18 within baffle plate 20. The contours that first and second stamped inner plates 16, 18 are formed to include are baffle ridges 22 coupled to respective channels 75, 77, 79, 94, 96, 98 and respective bases 81, 93 extending from a first edge 110 of first and second inner plates 16, 18 to a second edge 112 of first and second inner plates 16, 18 spaced apart from first edge 112 as shown, for example, in FIGS. 1 and 6. Ridges 22 divide channels 75, 77, 79, 94, 96, 98 into first portions 242 positioned between first ends 85, 87 of first and second inner plates 16, 18 and ridges 22 and second portions 244 positioned between second ends 97, 99 of first and second inner plates 16, 18 as shown in FIG. 1.

Baffle ridges 22 include a first transitional ramp portion 114 coupled to respective channels 75, 77, 79, 94, 96, a sealing portion 116 coupled to first transitional ramp portion 114, and a second transitional ramp portion 118 coupled to sealing portion 116 and respective channels 75, 77, 79, 94, 96, 98. First and second inner plates further include two dimple-shaped stops 120 coupled to sealing portion 116 of ridges 22 as shown in FIGS. 3, 5, 7, and 8. Sealing portion 116 and stops 120 extend outwardly away from bases 81, 93 and channels 75, 77, 79, 94, 96, 98 toward top and bottom outer shells 12, 14, respectively.

Baffle plate 20 is positioned to lie over first and second stamped inner plates 16, 18. First and second inner plates 16, 18 are inserted through inner plate-receiving aperture 74 of baffle plate 20 so that first and second stamped inner plates 16, 18 are positioned to lie in inner plate-receiving aperture 74. Inner edge 73 of inner flange 72 includes curved portions 278 defining notches 270 sized to receive channels 75, 77, 79, 94, 96, 98 included in first and second inner plates 16, 18 as shown, for example, in FIG. 1. Curved portions 278 contact ridges 22 that are coupled to channels 75, 77, 79, 94, 96, 98. By including baffle ridges 22 on first and second inner plates 16, 18, inner plate-receiving aperture 74 of baffle plate 20 can be enlarged and still substantially seal with first and second inner plates 16, 18.

The enlargement of inner plate-receiving aperture 74 provides clearance for projections that jut out from second portions 244 of channels 75, 77, 79, 94, 96, 98 to pass through inner plate-receiving aperture 74 during insertion of first and second inner plates 16, 18 through baffle plate 20. In the illustrated embodiment, the projections are louvers 212, 220, 228 on first and second inner plates 16, 18. After baffle plate 20 is inserted past louvers 212, 220, 228, sealing portions 116 of ridges 22 contact inner flange 73 to provide a substantial seal between first and second inner plates 16, 18 and baffle plate 20. Therefore, first and second stamped inner plates 16, 18 are inserted into inner plate-receiving aperture 74 so that louvers 212, 220, 228 pass through inner plate-receiving aperture 74 without substantial interference and ridges 22 of first and second inner plates 16, 18 and inner flange 72 of baffle plate 20 contact to provide a substantial seal between inner plates 16, 18 and baffle plate 20.

After baffle plate 20 is inserted past louvers 212, 220, 228 of first and second baffle plates 16, 18, ridges 22 of first and second stamped inner plates 16, 18 contact inner flange 72 of baffle plate 20 so that baffle plate 20 ramps up first transitional ramp portion 114 of ridges 22. As inner flange 72 ramps up transitional ramp portion 114, baffle 20 fits more snugly against ridges 22 of first and second inner stamped plates 16, 18 to form a substantial seal therewith. Baffle plate 20 continues to slide onto ridges 22 until flange 72 abuts and strikes stops 120. Stops 120 impede baffle plate 20 from moving toward first ends 85, 97 of first and second inner plates 16, 18 past a predetermined position as set by the placement of ridges 22 and stops 120.

Baffle plate 20 is positioned in a predetermined location and substantially sealed against first and second stamped inner plates 16, 18 by positioning and pressing baffle plate 20 over first and second stamped inner plates 16, 18 until baffle plate 20 abuts stops 120. Likewise, the enlargement of inner plate-receiving aperture 74 permits raised portions or projections, such as louvers 212, 220, 228, to slide though baffle plate 20.

As shown in FIG. 4, bases 81, 93 include first portions 254 positioned to lie between respective inlet and intermediate channels 75, 94, 79, 98 and second portions 256 positioned to lie between respective outlet and intermediate channels 77, 96, 79, 98. Each ridge 22 includes an inner surface 257, an outer surface 259, base portions 258 coupled to respective first and second portions 254, 256 of bases 81, 93, and curved channel portions 261 coupled to respective channels 75, 77, 79, 94, 96, 98 to contact curved portion 278 of baffle plate 20. Stops 120 are spaced apart and coupled to base portions 258, spaced apart from channels 75, 77, 79, 94, 96, 98, and positioned between channels 75, 77, 79, 94, 96, 98. According to alternative embodiments, stops 120 may be coupled anywhere on first and second inner plates 16, 18 to contact baffle 20 to prevent movement of baffle plate 20 toward first ends 85, 97 of first and second inner plates 16, 18.

First and second stamped inner plates 16, 18 cooperate to form a path for exhaust gas to flow through muffler 10. Each channel 75, 77, 79, 94, 96, 98 includes an inner surface 157 and an outer surface 155. When first and second stamped inner plates 16, 18 mate together, inlet channels 75, 94 cooperate to form an inlet tube 156 defining a passage 161 having an axis 163, outlet channels 77, 86 cooperate to form an outlet tube 158 defining a passage 246 having an axis 248, intermediate channels 79, 98 cooperate to form an intermediate tube 160 defining a passage 250 having an axis 252, and ducts 83, 95 cooperate to form a conduit 159 communicating and extending between intermediate tube 160 and outlet tube 158. In the illustrated embodiment, ridges 22 cooperate with channels 73, 77, 79, 94, 96, 98 to form inlet tube 156, outlet tube 158, and intermediate tube 160. In an alternative embodiment, ridges 22 may not cooperate to form any tubes. Conduit 159 prevents baffle plate 20 from being slide over first ends 85, 97 at first and second inner plates 16, 18. Thus, in the illustrated embodiment, baffle plate 20 is slid over louvers 212, 220, 228. In alternative embodiments, the shape of inner flange 72 of baffle plate 20 and ridge 22 may be changed to permit baffle plate 20 to slide over conduit 159.

Figure 7:
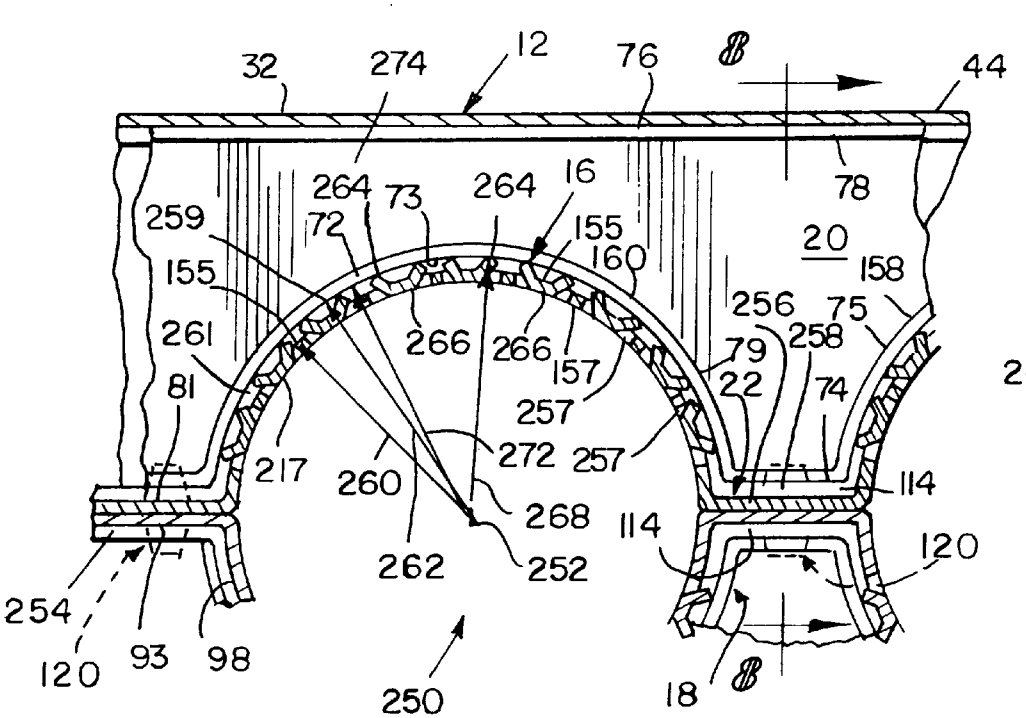
FIG. 7 is a partial sectional view, taken along line 7—7 of FIG. 8, showing the first and second stamped inner plates positioned within a plate-receiving aperture formed in the baffle plate.

As illustrated with reference to intermediate tube 160 shown in FIG. 7, outer surfaces 155 of channels 75, 77, 79, 94, 96, 98 are spaced apart from respective axis 163, 248, 252 by a first distance 260. Outer surface 259 of ridge 22 is spaced apart from respective axis 163, 248, 252 by a second distance 262 that is greater than first distance 260 such that channels 75, 77, 79, 94, 96, 98 are spaced apart from baffle 20. Inner flange 72 of baffle 20 is spaced apart from respective axis 163, 248, 252 by a third distance 272 that is greater than first distance 260 and substantially equal to second distance 262. The equality of third distance 272 and second distance 262 provides a snug sealing contact between ridges 22 of first and second inner plates 16, 18 and baffle plate 20.

The difference between first distance 260 and third distance 272 provides clearance for projections such as louvers 212, 220, 228 to pass through inner plate-receiving aperture 72 during sliding of baffle plate 20 over first and second inner plates 16, 18. Louvers 212, 220, 228 include base portions 266 coupled to respective channels 75, 77, 79, 94, 96, 98 and outer portions 264 coupled to base portions 266 that extend away from respective axis 163, 248, 252 by a fourth distance 268 that is less than second distance 262 and greater than first distance 260. Because fourth distance 268 is less than third distance 272, louvers 212, 220, 228 slide through inner plate-receiving aperture 74 during insertion of first and second inner plates 16, 18 through baffle 20.

Exhaust gas flows from muffler inlet 38 to muffler outlet 40 along a serpentine path through inlet tube 156, intermediate tube 160, conduit 159, and outlet tube 158. In preferred embodiments of the present invention, first and second inner plates 16, 18 are connected together by seam welding between and along the length of each channel 75, 77, 79, 94, 96, 98.

Inlet tube 156 permits communication of exhaust gas from an exhaust system (not shown) to second subchamber 84. Inner surfaces 157 of inlet channels 75, 94 cooperate to define passage 161 extending through inlet tube 156 and having axis 163. Inlet tube 156 includes a first end 164 that lies in inlet passageways 48, 68 formed in top and bottom outer shells 12, 14 and a second end 166 positioned to lie adjacent to second end walls 36, 56 of top and bottom outer shells 12, 14 as shown, for example, in FIGS. 5 and 6. At first end 164 of inlet tube 156, inlet channel 75 of first stamped inner plate 16 is formed to include an open end 210 and inlet channel 94 of second stamped inner plate 18 is also formed to include an open end 212. Open ends 210, 212 cooperate to form an opening 234 that permits communication between inlet tube 156 and the exhaust system. At second end 166 of inlet tube 156, inlet channel 75 of first stamped inner plate 16 is formed to include an open end 168 and inlet channel 94 of second stamped inner plate 18 is also formed to include an open end 170. Open ends 168, 170 cooperate to form an opening 169 that permits communication between inlet tube 156 and second subchamber 84.

Outlet tube 158 permits communication of exhaust gases from muffler 10 to the remainder of the exhaust system (not shown). Inner surfaces 157 of outlet channels 75, 94 cooperate to define passage 246 extending through inlet tube 156 and having axis 248. Outlet tube 158 includes a first end 172 positioned to lie adjacent to conduit 59 and a second end 174 that lies in outlet passageways 50, 70 formed in top and bottom outer shells 12, 14 as shown, for example, in FIGS. 5 and 6. At first end 172 of outlet tube 158, outlet channels 77, 96 include closed ends 238, 240 that transition into conduit 159 and allows communication between intermediate tube 160 and outlet tube 158. At second end 174 of outlet tube 158, outlet channels 77, 96 of first and second inner plates 16, 18, respectively, are formed to include open ends 176, 178. Open ends 176, 178 cooperate to form an opening 236 that permits communication between outlet tube 158 and the remainder of the exhaust system.

Intermediate tube 160 permits communication of exhaust gas from second subchamber 84 to first subchamber 82 and outlet tube 158. Inner surfaces 157 of outlet channels 75, 94 cooperate to define passage 250 extending through inlet tube 156 and having axis 252. Intermediate tube 160 includes a first end 180 positioned to lie adjacent to first end walls 34, 54 of top and bottom stamped outer shells 12, 14 and a second end 182 positioned to lie adjacent to second end walls 36, 56 of top and bottom stamped outer shells 12, 14, as shown, for example, in FIG. 6. At second end 182 of intermediate tube 160, intermediate channels 79, 98 of first and second inner plate 16 are formed to include open ends 188, 190, respectively. Open ends 188, 190 cooperate to form an opening 171 through which exhaust noise travels between second subchamber 84 and intermediate tube 160.

Intermediate channels 79, 98 include tapered portions 165, 167 at first end 180 of intermediate tube 160 that provide a transition in intermediate tube 160 to form a tuning throat 192 as shown in FIGS. 4 and 6. At first end 180 of intermediate tube 160, intermediate channels 79, 98 of first and second inner plates 16, 18, respectively, are formed to include open ends 184, 186, respectively. Open ends 184, 186 cooperate to form an opening 173 in tuning throat 192 through which exhaust gas travels between intermediate tube 160 and first subchamber 82 as shown in FIG. 6. Tuning throat 192 allows low frequency noise to pass into first subchamber 82 that forms a Helmholtz tuning chamber for the attenuation of such low frequency noise.

Exhaust gas travels from the exhaust system (not shown) into muffler 10 along a serpentine path until it exits muffler 10. Exhaust gas enters muffler 10 through opening 234 in first end 164 of inlet tube 156 in direction 196 as shown in FIG. 6. Exhaust gas flows through inlet tube 156 and exits inlet tube 156 in direction 198 through opening 169 into second subchamber 84. A portion of inlet channel 77 of inlet tube 156 lying in second subchamber 84 is formed to include louvers 212 through which exhaust gas in inlet tube 156 communicates with second subchamber 84.

Exhaust gas continues flowing in direction 214 from second subchamber 84 through opening 171 of intermediate tube 160 as shown in FIG. 6. Exhaust gas flows through intermediate tube 160 and exits intermediate tube 160 in direction 218 through conduit 159 into outlet tube 158 as shown in FIG. 6. A portion of intermediate tube 160 lying in second subchamber 84 is formed to include louvers 220 through which exhaust gas communicates with second subchamber 84. As previously mentioned, tuning throat 192 permits exhaust gas to communicate between intermediate tube 160 and first subchamber 82.

Outlet tube 158 is formed to include louvers 228 through which exhaust gas in outlet tube 158 communicates with second subchamber 84. Exhaust gas then exits muffler 10 in direction 230 through second end 174 of outlet tube 158 as shown in FIG. 6 into the remainder of the exhaust system (not shown). In alternative embodiments of the present invention, the inlet tube, outlet tube, and tube may be formed to include perforations (not shown) instead of louvers.

Although the invention has been disclosed in detail with reference to certain preferred embodiments, variations and modifications exist within the scope and spirit of the invention.

What is claimed is:

1. A muffler comprising an outer shell defining a chamber, a baffle positioned in the chamber defined by the outer shell, the baffle including an inner plate-receiving aperture, an outer edge positioned adjacent to the outer shell and an inner edge, a first inner plate positioned in the chamber defined by the outer shell, the first inner plate including a first end, a second end, a base, a channel coupled to the base, and a ridge coupled to the channel, the channel including an inner surface, an outer surface, a first portion positioned between the first end of the first inner plate and the ridge and a second portion positioned between the second end of the first inner plate and the ridge, and a second inner plate positioned in the chamber defined by the outer shell, the first and second inner plates being positioned in the inner plate-receiving aperture of the baffle, the second inner plate including a first end, a second end, a base, a channel coupled to the base, and a ridge coupled to the channel, the channel including an inner surface, an outer surface, a first portion positioned between the first end of the second inner plate and the ridge and a second portion positioned between the second end of the second inner plate and the ridge, the inner surfaces of the channels of the first and second inner plates cooperating to define a passage therebetween having an axis, the second portions of the first and second inner plates including a plurality of louvers having a base portion coupled to the second portions of the first and second inner plates and an outer portion spaced apart from the axis by a first distance, the outer surface of the channels of the first and second inner plates being spaced apart from the axis by a second distance that is less than the first distance, the outer surface of the ridges of the first and second inner plates being spaced apart from the axis by a third distance that is greater than the first and second distances so that the ridges are positioned adjacent to the inner edge of the baffle, the inner edge of the baffle being spaced apart from the respective channel, and each ridge including a stop that contacts the baffle to prevent movement of the baffle toward one of the first and second ends of the first and second inner plates.

2. The muffler of claim 1, wherein the first and second inner plates each include first and second channels, the first channels of the first and second inner plates cooperate to define a first passage therebetween, the second channels of the first and second inner plates cooperate to define a second passage therebetween, each channel includes a first portion positioned between the first ends of the first and second inner plates and the ridges and a second portion positioned between the second ends of the first and second inner plates and the ridges, and the first and second inner plates each include a duct connecting the first portions of first and second channels to permit communication between the first passage and the second passage.

3. A muffler comprising an outer shell defining a chamber, a baffle positioned in the chamber defined by the outer shell, the baffle including an inner plate-receiving aperture, an outer edge positioned adjacent to the outer shell and an inner edge, a first inner plate positioned in the chamber defined by the outer shell, the first inner plate including a first end, a second end, a base, a channel coupled to the base, and a ridge coupled to the channel, the channel including an inner surface, an outer surface, a first portion positioned between the first end of the first inner plate and the ridge and a second portion positioned between the second end of the first inner plate and the ridge, and a second inner plate positioned in the chamber defined by the outer shell, the first and second inner plates being positioned in the inner plate-receiving aperture of the baffle, the second inner plate including a first end, a second end, a base, a channel coupled to the base, and a ridge coupled to the channel, the channel including an inner surface, an outer surface, a first portion positioned between the first end of the second inner plate and the ridge and a second portion positioned between the second end of the second inner plate and the ridge, the inner surfaces of the channels of the first and second inner plates cooperating to define a passage therebetween having an axis, the second portions of the first and second inner plates including a plurality of louvers having a base portion coupled to the second portions of the first and second inner plates and an outer portion spaced apart from the axis by a first distance, the outer surface of the channels of the first and second inner plates being spaced apart from the axis by a second distance that is less than the first distance, the outer surface of the ridges of the first and second inner plates being spaced apart from the axis by a third distance that is greater than the first and second distances so that the ridges are positioned adjacent to the inner edge of the baffle, each ridge including a stop that contacts the baffle to prevent movement of the baffle toward one of the first and second ends of the first and second inner plates, the first and second inner plates each including first and second channels, the first channels of the first and second inner plates cooperating to define a first passage therebetween, the second channels of the first and second inner plates cooperating to define a second passage therebetween, each channel including a first portion positioned between the first ends of the first and second inner plates and the ridges and a second portion positioned between the second ends of the first and second inner plates and the ridges, the first and second inner plates each including a duct connecting the first portions of first and second channels to permit communication between the first passage and the second passage, each of the first channels of the first and second inner plates including an open end at the first ends of the first and second inner plates and an open end at the second ends of the first and second inner plates and each of the second channels including a closed end at the first ends of the first and second inner plates and an open end at the second ends of the first and second inner plates.

4. The muffler of claim 1, wherein the first and second inner plates include first, second, and third channels and the ridges are coupled to the first, second, and third channels.

5. A muffler comprising an outer shell defining a chamber, a baffle positioned in the chamber defined by the outer shell, the baffle including an inner plate-receiving aperture, an outer edge positioned adjacent to the outer shell and an inner edge, a first inner plate positioned in the chamber defined by the outer shell, the first inner plate including a first end, a second end, a base, a channel coupled to the base, and a ridge coupled to the channel, the channel including an inner surface, an outer surface, a first portion positioned between the first end of the first inner plate and the ridge and a second portion positioned between the second end of the first inner plate and the ridge, and a second inner plate positioned in the chamber defined by the outer shell, the first and second inner plates being positioned in the inner plate-receiving aperture of the baffle, the second inner plate including a first end, a second end, a base, a channel coupled to the base, and a ridge coupled to the channel, the channel including an inner surface, an outer surface, a first portion positioned between the first end of the second inner plate and the ridge and a second portion positioned between the second end of the second inner plate and the ridge, the inner surfaces of the channels of the first and second inner plates cooperating to define a passage therebetween having an axis, the second portions of the first and second inner plates including a plurality of louvers having a base portion coupled to the second portions of the first and second inner plates and an outer portion spaced apart from the axis by a first distance, the outer surface of the channels of the first and second inner plates being spaced apart from the axis by a second distance that is less than the first distance, the outer surface of the ridges of the first and second inner plates being spaced apart from the axis by a third distance that is greater than the first and second distances so that the ridges are positioned adjacent to the inner edge of the baffle, and each ridge including a stop that contacts the baffle to prevent movement of the baffle toward one of the first and second ends of the first and second inner plates, the first and second inner plates including first and second channels, and the stops being positioned between the first and second channels.

6. The muffler of claim 1, wherein each ridge includes a sealing portion in contact with the inner edge of the baffle and a ramp portion coupled to the sealing portion and the respective channel and the ramp portion is tapered relative to the axis.

7. A muffler comprising an outer shell defining a chamber, a baffle positioned in the chamber defined by the outer shell, the baffle including an inner plate-receiving aperture, a first inner plate positioned in the chamber defined by the outer shell, and a second inner plate positioned in the chamber and including a base, a channel coupled to the base, and a ridge coupled to the base, the first and second inner plates being positioned in the inner plate-receiving aperture of the baffle, the channel of the second inner plate and the first inner plate cooperating to define a passage therebetween, the base of the second inner plate defining a plane partitioning the outer shell into first and second outer shell portions.

8. The muffler of claim 7, wherein the baffle includes a base and a continuous inner flange coupled to the base of the baffle, the inner flange defining the inner plate-receiving aperture.

9. The muffler of claim 8, wherein the second inner plate includes first, second, and third channels, each channel cooperates with the first inner plate to define a passage therebetween, the base of each second inner plate includes a first portion positioned between the first and second channels and contacting the first inner plate and a second portion positioned between the second and third channels and contacting the first inner plate, and the inner flange of the baffle is sized to receive the first, second, and third channels, and the first and second portions of the base of the second inner plate.

10. A muffler comprising an outer shell defining a chamber, a baffle positioned in the chamber defined by the outer shell, a first inner plate positioned in the chamber, and a second inner plate positioned in the chamber, the second inner plate including a channel having an inner surface and an outer surface and a ridge coupled to the channel, the ridge including an inner surface and an outer surface, the inner surface of the channel and the first inner plate cooperate to define a passage therebetween having an axis, the outer surface of the channel being spaced apart from the axis by a first distance and from the baffle, the outer surface of the ridge being spaced apart from the axis by a second distance that is greater than the first distance so that the outer surface of the ridge is positioned adjacent to the baffle.

11. The muffler of claim 10, wherein the second inner plate includes a first end, a second end spaced apart from the first end, the channel includes a first portion positioned to lie between the first end of the second inner plate and the ridge and a second portion positioned between the second end of the second inner plate and the ridge, the second inner plate further includes a projection extending from the second portion of the channel toward the outer shell to a third distance away from the axis that is greater than the first distance and less than the second distance.

12. A muffler comprising an outer shell defining a chamber, a baffle positioned in the chamber defined by the outer shell, a first inner plate positioned in the chamber, and a second inner plate positioned in the chamber, the second inner plate including a channel having an inner surface and an outer surface and a ridge coupled to the channel, the ridge including an inner surface and an outer surface, the inner surface of the channel and the first inner plate cooperate to define a passage therebetween having an axis, the outer surface of the channel being spaced apart from the axis by a first distance, the outer surface of the ridge being spaced apart from the axis by a second distance that is greater than the first distance so that the outer surface of the ridge is positioned adjacent to the baffle, the second inner plate including a base coupled to the channel and positioned adjacent to the first inner plate, and the ridge being coupled to the base.

13. The muffler of claim 12, wherein the second inner plate includes a first end and a second end spaced apart from the first end, the ridge includes a channel portion coupled to the channel and a base portion coupled to the base, and the second inner plate includes a stop coupled to the base portion of the ridge to contact the baffle and prevent movement of the baffle toward one of the first and second ends of the second inner plate.

14. The muffler of claim 10, wherein the second inner plate includes a first end and a second end spaced apart from the first end, and a stop positioned to contact the baffle and prevent movement of the baffle toward one of the first and second ends of the second inner plate.

15. The muffler of claim 10, wherein the ridge includes a sealing portion in contact with the baffle and a ramp portion coupled to the sealing portion and the channel and the ramp portion is tapered relative to the axis.

16. The muffler of claim 10, wherein the second inner plate includes a first end, a second end spaced apart from the first end, and a projection coupled to the channel between the first and second ends, the projection includes a base portion coupled to the channel and an outer portion extending away from the channel to a third distance spaced apart from the axis by a third distance that is greater than the first distance and less than the second distance.

17. The muffler of claim 16, wherein the projection is a louver.

18. A muffler comprising an outer shell defining a chamber, a baffle positioned in the chamber defined by the outer shell, a first inner plate positioned in the chamber, and a second inner plate positioned in the chamber, the second inner plate including a channel, a base, and a ridge coupled to the channel and the base, the channel and the first inner plate cooperating to define a passage therebetween having an axis, the ridge extending away from the channel and the axis, and the baffle including an outer edge positioned adjacent to the outer shell and an inner edge positioned adjacent to the ridge.

19. A muffler comprising an outer shell defining a chamber, a baffle positioned in the chamber defined by the outer shell, a first inner plate positioned in the chamber, and a second inner plate positioned in the chamber, the second inner plate including a channel and a ridge coupled to the channel, the channel and the first inner plate cooperating to define a passage therebetween having an axis, the ridge extending away from the channel and the axis, and the baffle including an outer edge positioned adjacent to the outer shell and an inner edge positioned adjacent to the ridge, the second inner plate including first, second, and third channels and a base including a first portion positioned between the first and second channels and a second portion positioned between the second and third channels, and the ridge being coupled to the first, second, and third channels and the first and second portions of the base.

20. The muffler of claim 19, wherein the second inner plate includes a first end, a second end spaced apart from the first end, a first stop positioned to contact the baffle and prevent movement of the baffle toward one of the first and second ends and a second stop spaced apart from the first stop and positioned to contact the baffle and prevent movement of the baffle toward one of the first and second ends.

21. The muffler of claim 20, wherein the first and second stops are coupled to the ridge.

22. The muffler of claim 18, wherein the ridge is curved and the inner edge of the baffle includes a curved portion configured to contact the ridge.

23. The muffler of claim 18, wherein the outer shell includes a first end, a second end spaced apart from the first end, and a groove and the outer edge of the baffle is positioned in the groove to prevent movement of the baffle toward one of the first and second ends of the outer shell.

24. The muffler of claim 23, wherein the second inner plate includes a first end, a second end spaced apart from the first end, and a stop positioned to contact the baffle and prevent movement of the baffle toward one of the first and second ends of the second inner plate and a second stop spaced apart from the first stop and positioned to prevent movement of the baffle toward one of the first and second ends.

25. A muffler comprising an outer shell defining a chamber, a baffle positioned in the chamber defined by the outer shell, a first inner plate positioned in the chamber, and a second inner plate positioned in the chamber, the second inner plate including a first end, a second end, a channel, and at least two stops, the channel and the first inner plate cooperating to define a passage therebetween, each stop contacting the baffle to prevent movement of the baffle toward the same end of the second inner plate.

26. The muffler of claim 25, wherein each stop is dimple-shaped.

27. The muffler of claim 25, wherein the second inner plate includes a plurality of spaced-apart stops configured to contact the baffle to prevent movement of the baffle toward one of the first and second ends of the second inner plate.

28. A muffler comprising an outer shell defining a chamber, a baffle positioned in the chamber defined by the outer shell, a first inner plate positioned in the chamber, and a second inner plate positioned in the chamber, the second inner plate including a first end, a second end, a channel, and a stop, the channel and the first inner plate cooperating to define a passage therebetween, the stop contacting the baffle to prevent movement of the baffle toward one of the first and second ends of the second inner plate, the stop being spaced apart from the channel.

29. The muffler of claim 28, wherein the second inner plate includes a first channel and a second channel and the stop is positioned between the first and second channels.

30. The muffler of claim 28, wherein the second inner plate includes a ridge contacting the baffle and the stop is coupled to the ridge.

31. The muffler of claim 25, wherein the baffle includes a flange contacting the second inner plate and a base coupled to the flange and contacting the stop to prevent movement of the baffle toward one of the first and second ends of the second inner plate.

32. A method of assembling a muffler, the method including the steps of providing an outer shell defining a chamber, a baffle, a first inner plate, a second inner plate including a channel and a ridge coupled to the channel, the channel of the second inner plate and the first inner plate cooperating to define a passage therebetween, sliding the baffle relative to the second inner plate into contact with the ridge, and positioning the baffle, first inner plate, and second inner plate in the chamber defined by the outer shell.

33. The method of claim 32, wherein the baffle includes an inner plate-receiving aperture and further comprising the step of positioning the second inner plate within the inner plate-receiving aperture before sliding the baffle into contact with the ridge of the second inner plate.

34. The method of claim 32, wherein the second inner plate includes a stop and further comprising the step of contacting the baffle with the stop to prevent further sliding of the baffle relative to the second inner plate.

35. The method of claim 34, wherein the stop is coupled to the ridge.

36. A method of assembling a muffler, the method including the steps of providing an outer shell defining a chamber, a baffle, a first inner plate, a second inner plate including a channel and a ridge coupled to the channel, the channel of the second inner plate and the first inner plate cooperating to define a passage therebetween, sliding the baffle relative to the second inner plate into contact with the ridge, the second inner plate including a projection extending from the channel toward the outer shell and the baffle including an inner edge defining a notch sized to provide clearance between the inner edge of the baffle and the projection during sliding of the baffle relative to the second inner plate, and positioning the baffle, first inner plate, and second inner plate in the chamber defined by the outer shell.

37. The method of claim 36, wherein the projection is a louver.

38. A muffler comprising an outer shell defining a chamber, a baffle positioned in the chamber defined by the outer shell, and an inner plate positioned in the chamber, the inner plate including a channel and a ridge coupled to the channel, the ridge extending away from the channel, the baffle including an outer edge positioned adjacent to the outer shell and an inner edge positioned adjacent to the ridge, the inner edge of the baffle being spaced apart from the channel.

39. The method of claim 32, wherein the baffle is spaced apart from the channel of the second inner plate.

40. The method of claim 32, wherein the ridge of the second inner plate is positioned to lie between the channel of the second inner plate and the baffle.

41. The muffler of claim 7, wherein the ridge of the second inner plate is coupled to the channel of the second inner plate.

42. The muffler of claim 7, wherein the baffle includes a first portion extending between the first inner plate and the first outer shell portion and a second portion extending between the second inner plate and the second outer shell portion, the first portion of the baffle being integral with the second portion of the baffle.

* * * * *